US008653731B2

(12) United States Patent
Matsumoto

(10) Patent No.: US 8,653,731 B2
(45) Date of Patent: Feb. 18, 2014

(54) METAL HALIDE LAMP WITH STABILIZED LAMP LIGHTING

(71) Applicant: Iwasaki Electric Co., Ltd., Tokyo (JP)

(72) Inventor: Yasuhisa Matsumoto, Saitama (JP)

(73) Assignee: Iwasaki Electric Co., Ltd. (JP)

( * ) Notice: Subject to any disclaimer, the term of this patent is extended or adjusted under 35 U.S.C. 154(b) by 0 days.

(21) Appl. No.: 13/788,086

(22) Filed: Mar. 7, 2013

(65) Prior Publication Data

US 2013/0285542 A1 Oct. 31, 2013

(30) Foreign Application Priority Data

Apr. 27, 2012 (JP) ..... 2012-103111

(51) Int. Cl.
*H01J 17/26* (2012.01)
*H01J 17/00* (2006.01)
*H01J 11/00* (2012.01)

(52) U.S. Cl.
USPC ..... 313/623; 313/567; 313/637; 313/638; 313/639; 313/631; 313/632

(58) Field of Classification Search
None
See application file for complete search history.

(56) References Cited

U.S. PATENT DOCUMENTS

2011/0089828 A1* 4/2011 Kanazawa et al. ..... 313/638
2011/0279031 A1* 11/2011 Stockwald ..... 313/641

FOREIGN PATENT DOCUMENTS

JP 4210911 B2 1/2009
JP 2011-08935 A 1/2011
JP 4613257 B2 1/2011
JP 2011-70869 A 4/2011

* cited by examiner

*Primary Examiner* — Natalie Walford
(74) *Attorney, Agent, or Firm* — Lerner, David, Littenberg, Krumholz & Mentlik, LLP

(57) ABSTRACT

It is an object of the present invention to provide a metal halide lamp in which arc discharge in the initial stage of lamp lighting can be stabilized. A metal halide lamp includes a translucent outer tube with a base formed at one end thereof and a light-emitting portion disposed in the outer tube. This metal halide lamp is configured as a vertical mounting type such that the base thereof looks toward the upper side. The discharge tube has mercury and metal halides enclosed therein. Assuming that a lamp rated power is P [W], then a mercury concentration d(Hg) [μmol/cm$^3$] in the discharge tube falls within a range of values of ±10% of a mercury concentration d(Hg) obtained by the following equation "$d(Hg)=0.0007P^2-0.4113P+99.557$".

12 Claims, 2 Drawing Sheets

METAL HALIDE LAMP WITH STABILIZED LAMP LIGHTING

CROSS REFERENCE TO RELATED APPLICATIONS

The present application claims the benefit of and priority to JP Application No. 2012-103111, filed Apr. 27, 2012, the entire disclosure of which is incorporated by reference herein.

TECHNICAL FIELD

The present invention relates to a metal halide lamp that includes a discharge tube or luminous tube in which mercury and metal halides are enclosed, and particularly to a ceramic metal halide lamp of a vertically mounting type.

BACKGROUND ART

Since a metal halide lamp is able to emit light which is the closest to natural light and is excellent in color rendering properties as compared with a high-pressure sodium lamp and a mercury lamp, a metal halide lamp is suitable for use as a base light for illumination of offices and shops. In recent years, a ceramic metal halide lamp which uses a discharge tube made of translucent ceramics instead of a discharge tube made of quartz glass has come into a wide use. Mercury and metal halides are enclosed in a discharge tube of a ceramic metal halide lamp.

Generally, if a general color rendering index Ra is equal to or greater than 80 (Ra≥80) (greater than 1 B of rendering class in ISO8995), it is estimated as high color rendition and if a luminous efficiency η is proximately equal to or greater than 100 (η≥100), it is estimated as high luminous efficiency. High color rendition is incompatible to high luminous efficiency and it is difficult to accomplish both of them at the same time.

Patent Literature 1 discloses that metal halides are enclosed in a discharge tube in such a manner that an excessive content of halogen atoms relative to mercury may exist in the discharge tube in order to avoid the occurrence of a black burn phenomenon and to obtain a satisfactory light flux maintenance rate. Patent Literature 2 discloses an example of a metal halide lamp in which a luminous material containing at least one kind of cerium and praseodymium is enclosed in a discharge tube. Patent Literature 3 discloses an example of a metal halide lamp with high color rendering properties and high luminous efficiency which can be attained by enclosing metal iodides as metal halides in a discharge tube. Patent Literature 4 discloses an example of a ceramic metal halide lamp which includes power supply wires to enable the lamp to stabilize arc discharge in the initial stage of lamp lighting.

PRIOR ART DOCUMENT

Patent Literature

[Patent Literature 1] Japanese Patent No. 4210911
[Patent Literature 2] Japanese Patent No. 4613257
[Patent Literature 3] Japanese Unexamined Patent Publication No. 2011-08935
[Patent Literature 4] Japanese Unexamined Patent Publication No. 2011-70869

SUMMARY OF THE INVENTION

Problems to be Solved by the Invention

It has been customary that a ceramic metal halide lamp can realize high luminous efficiency and high color rendering properties by increasing a bulb wall loading of a discharge tube and a vapor pressure in the discharge tube. However, sometimes arc discharge becomes unstable in the initial stage of lamp lighting. That is, in the initial stage of lamp lighting (immediately after the lamp lighting to several hours later), a vapor pressure in the discharge space becomes higher than a vapor pressure in stable lighting state (100 hours after the lamp lighting) and a convection of vapor becomes unstable, giving rise to arc discharge abnormalities such as a bending of arc discharge.

It is an object of the present invention to provide a metal halide lamp that can stabilize arc discharge in the initial stage of lamp lighting.

Means for Solving the Problems

The inventor of the present invention has found that a value of a vapor pressure in a discharge tube is important for stabilizing arc discharge in the initial stage of lamp lighting. Meanwhile, the inventor of the present invention has found that the stability of arc discharge in the initial stage of lamp lighting can be improved by properly setting a mercury concentration in the discharge tube.

According to the present invention, a metal halide lamp of a vertically mounting type comprising a translucent outer tube having a base formed at one end thereof and a light-emitting portion disposed in said outer tube, said metal halide lamp being applied to be mounted such that said base looks toward the upper side, characterized in that said light-emitting portion includes a discharge tube made of translucent ceramics, capillaries extended from both ends of said discharge tube, electrode assemblies enclosed in said capillaries and power supply lead wires extended from both ends of said electrode assemblies, a lamp rated power P [W] is selected so as to satisfy P=100 to 400 [W], if an effective length of said discharge tube is selected to be L and an effective inner diameter is selected to be ID, then 1.8≤L/ID≤2.3 is satisfied, said discharge tube has mercury and metal halides enclosed therein and if a lamp rated power is selected to be P, then a mercury concentration d(Hg) [μmol/cm$^3$] in said discharge tube falls within a range of ±10% of a mercury concentration d(Hg) given by the following equation.

$$d(\mathrm{Hg})=0.0007P^2-0.4113P+99.557$$

According to one aspect of the present invention, the metal halide lamp may be characterized in that said mercury concentration d(Hg) in said discharge tube is selected so as to fall within a range of d(Hg)=39.0 to 63.0 [μmol/cm$^3$].

According to one aspect of the present invention, the metal halide lamp may be characterized in that a bulb wall loading defined by a value obtained when said lamp rated power P [W] is divided by a whole inner surface area S [cm$^2$] falls within a range of 15 to 25 [W/cm$^2$].

According to one aspect of the present invention, the metal halide lamp may be characterized in that a mercury concentration in said discharge tube falls within a range of 43 to 48 [μmol/cm$^3$] and that a metal halide concentration d(MX) in said discharge tube falls within a range of 6 to 7 [μmol/cm$^3$].

According to one aspect of the present invention, the metal halide lamp may be characterized in that said discharge tube contains thulium iodide ($TmI_3$), thallium iodide (TlI), sodium iodide (NaI), calcium iodide ($CaI_2$) and cerium iodide ($CeI_3$) as said metal halides.

According to one aspect of the present invention, the metal halide lamp may be characterized in that said cerium iodide ($CeI_3$) has a molar ratio [%] ranging of from 4 to 5%.

Effects of Invention

According to the present invention, it is possible to provide a metal halide lamp in which arc discharge can be stabilized in the initial stage of lamp lighting.

MODES FOR CARRYING OUT THE INVENTION

Figure 1:
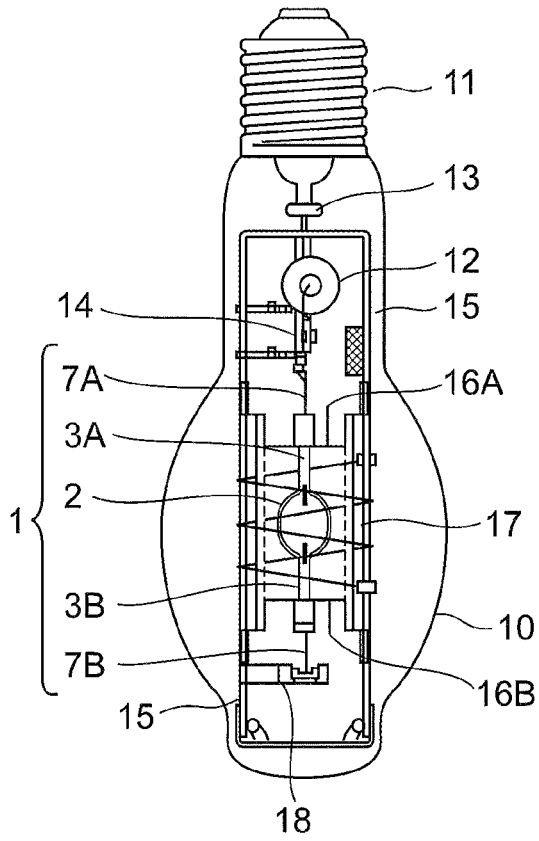
FIG. 1 is a diagram for explaining a structure of ceramic metal halide lamp according to an embodiment of the present invention.

A ceramic metal halide lamp according to embodiments of the present invention will hereinafter be described in detail with reference to the attached drawings. It should be noted that identical elements in the drawings are denoted by identical reference numerals and will not be explained repeatedly.

A ceramic metal halide lamp according to an embodiment of the present invention will be described with reference to FIG. 1. A ceramic metal halide lamp according to the embodiment of the present invention includes a translucent outer tube 10 with a base 11 formed at one end thereof and a light-emitting portion 1 disposed in the translucent outer tube. The light-emitting portion 1 includes a discharge tube 2 disposed at the center thereof, capillaries 3A, 3B extended from respective ends of the discharge tube and power supply lead wires 7A, 7B extended from respective ends of the capillaries.

Supports 14, 15 are attached to a stem 13 of the base 11. The supports 14, 15 have a starter 12 and support disks 16A, 16B attached thereto. The starter 12 is comprised of suitable assembly components such as a nonlinear ceramic capacitor which supplies a starting voltage to the electrodes of the discharge tube. A translucent sleeve 17 is fixed to the support disks 16A, 16B in such a manner as to surround the discharge tube 2. The capillaries 3A, 3B of the light-emitting portion 1 are inserted into insertion apertures of the support disks 16A, 16B, respectively. The power supply lead wires 7A, 7B of the light-emitting portion 1 are electrically connected to the base 11 by either directly welding them to the supports 14, 15 or by welding them to the supports via a nickel ribbon line 18. The power supply lead wires 7A, 7B of the light-emitting portion 1 are further electrically connected to the starter 12.

A nitrogen gas as an inert gas is enclosed in the translucent outer tube 10. The ceramic metal halide lamp according to the embodiment of the present invention is of a vertical mounting type and therefore this ceramic metal halide lamp is mounted in such an attitude that the base 11 looks toward the upper side.

Figure 2:
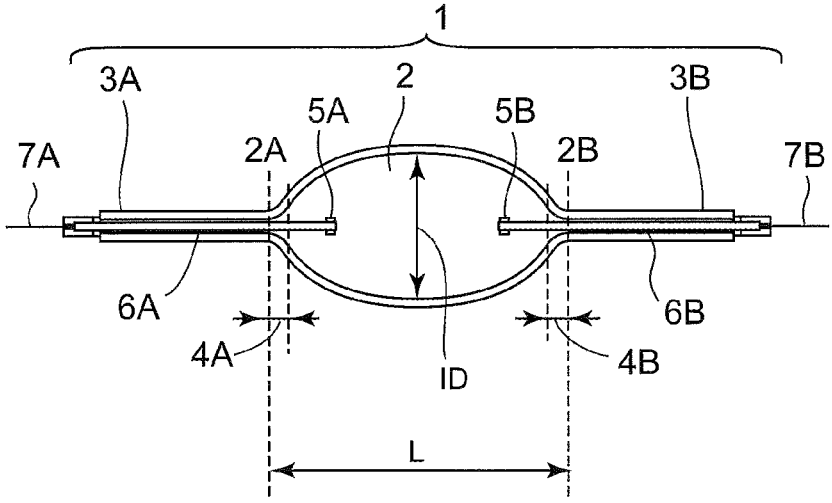
FIG. 2 is a diagram for explaining a structure of light-emitting portion of a metal halide lamp according to an embodiment of the present invention.

The light-emitting portion of the metal halide lamp according to an embodiment of the present invention will be described with reference to FIG. 2. The light-emitting portion 1 includes the discharge tube 2 and the pair of capillaries 3A, 3B extended along the respective end sides of the discharge tube. A pair of electrode assemblies 6A, 6B with the electrodes 5A, 5B attached thereto are inserted into the capillaries 3A, 3B, respectively. The power supply lead wires 7A, 7B are connected to the respective ends of the electrode assemblies 6A, 6B. The respective ends of the capillaries 3A, 3B are sealed in an airtight fashion by a sealant such as frit glass having electric insulating property. At the same time, the electrode assemblies 6A, 6B are fixed to predetermined positions in the capillaries 3A, 3B by the sealant. The light-emitting portion 1 according to the embodiment of the present invention is referred to as one-piece type, since such light-emitting portion is integrally formed by molding a compressed body of translucent alumina powder.

The discharge tube 2 is shaped as a substantially elliptic spherical surface formed when an ellipse is rotated around its major axis. Between the discharge tube 2 and the capillaries 3A, 3B transition curved surfaces 4A, 4B are formed continuously by which a unitary body without corner portions is shaped.

An effective length L and an effective inner diameter ID of the discharge tube are defined as inner sizes of the discharge tube 2. The effective length L is defined by a distance between portions 2A and 2B at which the straight shape capillaries 3A, 3B are changed to the continued transition curved surfaces 4A, 4B and the inner diameters start expanding. The effective inner diameter ID is defined by a maximum inner diameter of the central portion between the electrodes 5A and 5B if the discharge tube is of the one-piece type discharge tube.

According to the embodiment of the present invention, assuming that L represents the effective length of the discharge tube 2 and that ID represents the effective inner diameter of the discharge tube, then a ratio L/ID between the effective length and the effective inner diameter will be referred to as an aspect ratio. The discharge tube is designed such that the aspect ratio may fall within a range of $1.8 \leq L/ID \leq 2.3$ According to the embodiment of the present invention, a bulb wall loading falls within a range of 15 to 25 [W/cm$^2$]. Here, "bulb wall loading" is defined by a value obtained when a lamp power P [W] is divided by a whole inner area S [cm$^2$] of the discharge tube 2. In the ceramic metal halide lamp according to the present invention, since the aspect ratio L/ID lies in a range of 1.8 to 2.3, the whole inner area S [cm$^2$] of the discharge tube 2 is increased comparatively and hence the bulb wall loading can be decreased comparatively. For this reason, it is possible to realize high luminous efficiency and high color rendering properties without sacrificing a lamp life.

Temperatures at the respective portions of the light-emitting portion 1 are determined by the bulb wall loading of the discharge tube, the pressure of the gas enclosed in the translucent outer tube, the quality of the material of the discharge tube and the aspect ratio (L/ID) of the discharge tube. According to the embodiment of the present invention, the bulb wall loading of the discharge tube, the pressure of the gas enclosed in the translucent outer tube, the quality of the material of the discharge tube and the aspect ratio (L/ID) of the discharge tube are set in such a manner that at the lamp lighting, the temperature at the coldest portion of the discharge tube may become higher than 800° C. and the maximum temperature of the discharge tube may become lower than 1200° C.

Metal halides, mercury and a starting rare gas are enclosed in the discharge tube 2. At least, thulium iodide ($TmI_3$), thallium iodide (TlI), sodium iodide (NaI), calcium iodide ($CaI_2$) and cerium iodide ($CeI_3$) are enclosed in the discharge tube as metal halides.

For example, the thulium iodide ($TmI_3$) and the thallium iodide (TlI) may be enclosed in the discharge tube with molar ratios of 10 to 20% and 5 to 10% relative to all metal halides, respectively. The sodium iodide (NaI) and the calcium iodide (Cab) may be enclosed in the discharge tube with molar ratios of 60 to 80% and 5 to 7% relative to all metal halides, respectively. Further, the cerium iodide ($CeI_3$) may be enclosed in the discharge tube with a molar ratio of 4 to 5% relative to all metal halides.

Moreover, if necessary, holmium iodide ($HoI_3$) and dysprosium iodide ($DyI_3$) may be enclosed in the discharge tube with a molar ratio of 1 to 3% relative to all metal halides.

Mercury as a metal simple substance and mercury halide or a mixture of these mercury and mercury halide are enclosed in the discharge tube as mercury. Contents and concentrations of mercury will be described later on.

TABLE 1

| Test No. | | No. 1 | No. 2 | No. 3 | No. 4 | No. 5 | No. 6 | No. 7 | No. 8 | No. 9 |
|---|---|---|---|---|---|---|---|---|---|---|
| Mounting Attitude of Lamp | | Vertical | Vertical | Vertical | Vertical | Vertical | Vertical | Vertical | Vertical | Vertical |
| Rated Power: P[W] | | 110 | 150 | 190 | 230 | 270 | 360 | 190 | 190 | 230 |
| Specification of Discharge Tube | Effective Length: L[mm] | 23 | 25.4 | 27.9 | 30.6 | 30.55 | 36 | 27.9 | 27.9 | 30.6 |
| | Effective Inner Diameter: ID[mm] | 10 | 12.4 | 13.6 | 14.9 | 16.8 | 18 | 13.6 | 13.6 | 14.9 |
| | Aspect Ratio: L/ID | 2.30 | 2.05 | 2.05 | 2.05 | 1.82 | 2.00 | 2.05 | 2.05 | 2.05 |
| | Volume: $V_0$[$cm^3$] | 1.239 | 2.024 | 2.704 | 3.556 | 4.574 | 6.038 | 2.704 | 2.704 | 3.556 |

Example 1

Table 1 shows specifications of 9 kinds of lamps which the inventor of the present invention has used to carry out the arc discharge stability experiments. Experiments to investigate arc discharge stability in the initial stage of lamp lighting were performed under the condition that any of 9 kinds of lamps was mounted to a suitable device such as a ceiling in a vertical mounting attitude such that the base of the lamp looks toward the upper side. Table 1 shows measurement results of (1) lamp rated power P [W], (2) effective length L [mm] of discharge tube, (3) effective inner diameter ID [mm] of discharge tube, (4) aspect ratio L/ID of discharge tube and (5) volume $V_0$ [$cm^3$] of 9 kinds of lamps. The lamp rated power P [W] may fall within a range of P=100 to 400 and the aspect ratio L/ID may fall within a range of L/ID=1.8 to 2.3.

Table 2 shows experimental conditions of the arc discharge stability experiments performed by the inventor of the present invention. Table 2 shows (1) lamp voltage VL [V], (2) lamp current IL [A], (3) mercury content Hg [μmol] in the discharge tube, (4) mercury concentration d(Hg) [μmol/$cm^3$] in the discharge tube, (5) upper limit value and lower limit value of the mercury concentration (central value) in the discharge tube and (6) results of experiments of 9 kinds of lamps. The upper limit value and the lower limit value are obtained as ±10% of the central value of mercury concentration. In this experiment, the mercury concentration d(Hg) in the discharge tube lies in a range of d(Hg)=39.0 to 63.0 [μmol/$cm^3$] and it is relatively large. For example, in the example described in the Patent Literature 1, this concentration is less than d(Hg)=7.0 [mg/$cm^3$], i.e. the concentration is less than approximately 35 [μmol/$cm^3$].

In test numbers No. 1 to No. 6, results of experiments were obtained as "arc discharge is stable". Also, general color rendering indexes Ra of these lamps were measured and the results fell within a range of Ra=70 to 80, which means high

TABLE 2

| Test No. | | No. 1 | No. 2 | No. 3 | No. 4 | No. 5 | No. 6 | No. 7 | No. 8 | No. 9 |
|---|---|---|---|---|---|---|---|---|---|---|
| Lamp Voltage: VL[V] | | 110 | 95 | 110 | 110 | 125 | 125 | 120 | 115 | 125 |
| Lamp Current: IL[A] | | 1.2 | 1.9 | 2.0 | 2.3 | 2.5 | 3.3 | 1.8 | 1.9 | 2.1 |
| Mercury Content: Hg [μmol] | | 77.5 | 109.7 | 129.6 | 154.5 | 179.5 | 269.6 | 159.5 | 144.6 | 179.5 |
| Mercury Conc.: d(Hg) | (Central value) [μmol/$cm^3$] | 62.5 | 54.2 | 47.9 | 43.5 | 39.2 | 44.6 | 59.0 | 53.5 | 50.5 |
| | (Upper Limit) [μmol/$cm^3$] | 68.8 | 59.6 | 52.7 | 47.8 | 43.2 | 49.1 | 64.9 | 58.8 | 55.5 |
| | (Lower Limit) [μmol/$cm^3$] | 56.3 | 48.8 | 43.1 | 39.1 | 35.3 | 40.2 | 53.1 | 48.1 | 45.4 |
| Result of Experiment (State of Arc) | | Stable | Stable | Stable | Stable | Stable | Stable | Unstable | Unstable | Unstable |

color rendering properties. On the other hand, in test numbers No. 7 to No. 9, results of experiments were obtained as "arc discharge is unstable".

Figure 3:
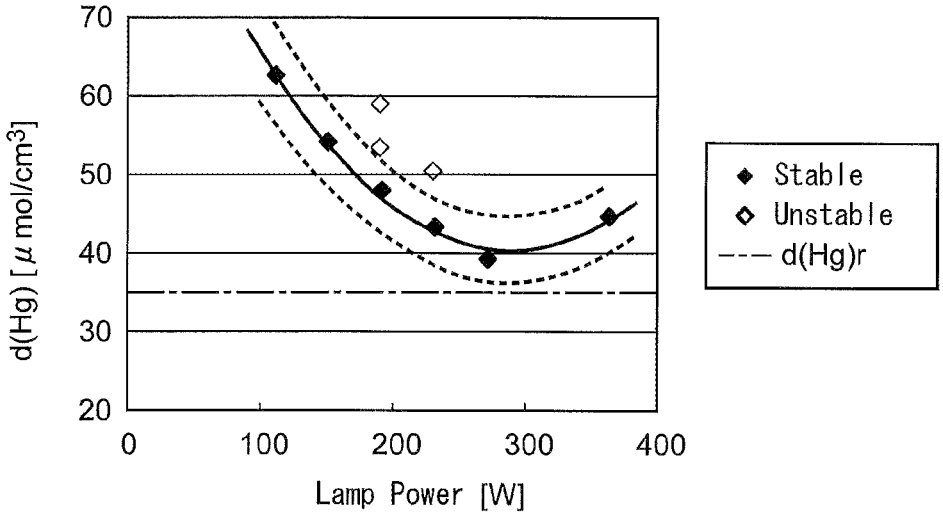
FIG. 3 is a graph showing results of arc discharge stabilizing experiments performed by the inventor of the present invention.

FIG. 3 is a diagram showing the results on table 2 in a graph representation. In this graph, the vertical axis represents the mercury concentration d(Hg) [μmol/cm$^3$] in the discharge tube and the horizontal axis represents the lamp power P [W]. Dots represented by solid squares show measurement results of the test numbers No. 1 to No. 6 and express that arc discharge is stable. Dots represented by open squares show measurement results of the test numbers No. 7 to No. 9 and express that arc discharge is unstable. Curves which pass the seven dots indicative of the results that arc discharge is stable were approximated by a quadratic curve. Here, a quadratic curve was obtained by a method of least squares. This quadratic curve is expressed by the following equation.

$$d(\mathrm{Hg})=0.0007P^2-0.4113P+99.557$$

However, a residual was $R^2=0.9905$. A solid line curve expresses the thus obtained quadratic curve. However, a broken line curve was obtained by calculating ±10% of the solid line quadratic curve as the central value. That is, the broken line curve shows a range of a mercury concentration d(Hg) [μmol/cm$^3$]±10%. A chained line shows a mercury concentration "d(Hg) r" (approximately 35 [μmol/cm$^3$]) described in the Patent Literature 1.

TABLE 3

| Test No. | Lamp Rated Power P[W] | Discharge Tube Volume: $V_0$[cm$^3$] | Mercury Concentration: d(Hg) [μmol/cm$^3$] | Result of Experiment (State of Arc) |
|---|---|---|---|---|
| No. 10a | 190 | 3.556 | 59 | Unstable |
| No. 10b | 190 | 3.556 | 53 | Unstable, Stable |
| No. 10c | 190 | 3.556 | 48 | Stable |

Example 2

Table 3 shows specifications of three kinds of lamps for use in the arc discharge stability experiments performed by the inventor of the present invention, experimental conditions and results of the experiments. A rated power of the lamp used in the experiments was 190 watt. With respect to these lamps of three kinds, mercury concentrations in the discharge tube were changed. In these experiments, mercury concentrations d(Hg) in the discharge tube are three mercury concentrations d(Hg)=48, 53 and 59 [μmol/cm$^3$] and they are large as compared with an example of mercury concentration (less than approximately 35 [μmol/cm$^3$]) described in the Patent Literature 1.

When the mercury concentration was set to d(Hg)=59 [μmol/cm$^3$], arc discharge was unstable. When the mercury concentration was set to d(Hg)=53 [μmol/cm$^3$], arc discharge was slightly unstable. When a mercury concentration was set to d(Hg)=48 [μmol/cm$^3$], arc discharge was stable. Accordingly, if a vapor pressure of mercury in the discharge space is lowered to the appropriate level, then a vapor convection become stable and hence arc discharge abnormalities in the initial stage of lamp lighting can be suppressed.

TABLE 4

| Test No. | Lamp Rated Power: P[W] | Discharge Tube Volume: $V_0$[cm$^3$] | Mercury Concentration: d(Hg) [μmol/cm$^3$] | Metal Halides Concentration: d(MX) [μmol/cm$^3$] | Result of Experiment (State of Arc) |
|---|---|---|---|---|---|
| No. 11a | 230 | 2.704 | 50 | 8.2 | unstable |
| No. 11b | 230 | 2.704 | 50 | 7.9 | unstable |
| No. 11c | 230 | 2.704 | 50 | 6.6 | unstable |
| No. 11d | 230 | 2.704 | 43 | 6.6 | stable |

Example 3

Table 4 shows specifications of four kinds of lamps used in the arc discharge stability experiments performed by the inventor of the present invention, experimental conditions and results of the experiments. A rated power of the lamps for use in the experiments was 230 watt. With respect to these four kinds of lamps, (1) mercury concentration in the discharge tube and (2) contents of metal halides in the discharge tube were changed. In these experiments, a mercury concentration d(Hg) in the discharge tube is set to d(Hg)=50 or 43 [μmol/cm$^3$] and it is large as compared with an example of a mercury concentration (approximately less than 35 [μmol/cm$^3$]) in the Patent Literature 1. In these experiments, the mercury concentration d(Hg) is sufficiently large as compared with a metal halide concentration d(MX) and d(Hg)>>d(MX) is satisfied. That is, the vapor pressure in the discharge tube is subject to the mercury concentration d(Hg).

When the mercury concentration was set to 50 [μmol/cm$^3$], arc discharge was unstable. On the other hand when the mercury concentration was set to 43 [μmol/cm$^3$], arc discharge was stable. Accordingly, if a vapor pressure of mercury in the discharge space is lowered to the proper level, then vapor convection becomes stable and arc discharge abnormalities in the initial stage of lamp lighting can be suppressed.

A study of the results on tables 3 and 4 reveals that, if the mercury concentration d(Hg) in the discharge tube falls within a range of 43 to 48 [μmol/cm$^3$], then it is possible to secure arc discharge stability in the initial stage of lamp lighting. Moreover, it should be noted that the metal halide concentration d(MX) may fall within a range of approximately 6 to 7 [μmol/cm$^3$].

TABLE 5

| Test No. | Lamp Rated Power: P[W] | Discharge Tube Volume: $V_0$[cm$^3$] | Metal Halides Concentration: d(MX) [μmol/cm$^3$] | Molar Ratio of Metal Halides: [%] | | | | | |
|---|---|---|---|---|---|---|---|---|---|
| | | | | $TmI_3$ | TlI | NaI | $CaI_2$ | $DyI_3$ | $CeI_3$ |
| No. 10 | 190 | 3.556 | 6.6 | 13.0 | 7.2 | 68.9 | 6.5 | 0.0 | 4.6 |
| No. 11 | 230 | 2.704 | 6.6 | 13.0 | 7.2 | 68.9 | 6.5 | 0.0 | 4.6 |

Example 4

Table 5 shows specifications of two kinds of lamps used in the arc discharge stability experiments performed by the inventor of the present invention, experimental conditions and experiment results. A rated power of the lamps used in the experiments was 190 watt and 230 watt. (1) mercury concentration in the discharge tube and (2) molar ratios [%] of metal halides in the discharge tube are shown on the table. As metal halides, thulium iodide ($TmI_3$), thallium iodide (TlI), sodium iodide (NaI), calcium iodide ($CaI_2$) and cerium iodide ($CeI_3$) are enclosed in the discharge tube.

For example, thulium iodide ($TmI_3$) and thallium iodide (TlI) may be enclosed in the discharge tube with molar ratios of 10 to 20% and 5 to 10% relative to all metal halides, respectively. Sodium iodide (NaI) and calcium iodide ($CaI_2$) may be enclosed in the discharge tube with molar ratios of 60 to 80% and 5 to 7% relative to all metal halides, respectively. Further, cerium iodide ($CeI_3$) may be enclosed in the discharge tube with molar ratios of 4 to 5% relative to all metal halides.

Here, although neither dysprosium iodide ($DyI_3$) nor holmium iodide ($HoI_3$) is enclosed in the discharge tube, the dysprosium iodide and the holmium iodide may be enclosed in the discharge tube with molar ratios of 1 to 3%.

Here, the discharge tube of one-piece type has been described so far. In discharge tube of two-piece type recently distributed in the market, two discharge tube assemblies are joined at the center of the discharge tube and hence this type of discharge tube includes a small groove defined at the center inner surface of the discharge tube. However, the present invention can also be applied to such two-piece type discharge tube.

While the metal halide lamps according to embodiments of the present invention have been described so far, these embodiments are described by way of example and may not limit the scope of the present invention. Addition, deletion, alteration, improvement and etc. made on embodiments of the present invention by one skilled in the art may fall within the scope of the present invention. A technical scope of the present invention may be determined by the descriptions of the appended claims.

EXPLANATION OF REFERENCE NUMERALS

1 . . . light-emitting portion, 2 . . . discharge tube, 3A, 3B . . . capillaries, 4A, 4B . . . transition curved surfaces, 5A, 5B . . . electrodes, 6A, 6B . . . electrode assemblies, 7A, 7B . . . power supply lead wires, 10 . . . translucent outer tube, 11 . . . base, 12 . . . starter, 13 . . . stem, 14, 15 . . . supports, 16A, 16B . . . support disks, 17 . . . translucent sleeve, 18 . . . nickel ribbon line, L . . . effective length of discharge tube, ID . . . effective inner diameter of discharge tube

The invention claimed is:

1. A metal halide lamp of a vertically mounting type comprising a translucent outer tube having a base formed at one end thereof and a light-emitting portion disposed in said outer tube, said metal halide lamp being applied to be mounted such that said base looks toward the upper side, characterized in that said light-emitting portion includes a discharge tube made of translucent ceramics, capillaries extended from both ends of said discharge tube, electrode assemblies enclosed in said capillaries and power supply lead wires extended from both ends of said electrode assemblies, a lamp rated power P [W] is selected so as to satisfy P=100 to 400 [W], if an effective length of said discharge tube is selected to be L and an effective inner diameter is selected to be ID, then $1.8 \leq L/ID \leq 2.3$ is satisfied, said discharge tube has mercury and metal halides enclosed therein and if a lamp rated power is selected to be P, then a mercury concentration d(Hg) [μmol/cm$^3$] in said discharge tube falls within a range of ±10% of a mercury concentration d(Hg) given by the following equation:

$$d(\mathrm{Hg})=0.0007P^2-0.4113P+99.557.$$

2. The metal halide lamp according to claim 1, characterized in that said mercury concentration d(Hg) in said discharge tube is selected so as to fall within a range of d(Hg) =39.0 to 63.0 [μmol/cm$^3$].

3. The metal halide lamp according to claim 1, characterized in that a bulb wall loading defined by a value obtained when said lamp rated power P [W] is divided by a whole inner surface area S [cm$^2$] falls within a range of 15 to 25 [W/cm$^2$].

4. The metal halide lamp according to claim 1, characterized in that a mercury concentration in said discharge tube falls within a range of 43 to 48 [μmol/cm$^3$] and that a metal halide concentration d(MX) in said discharge tube falls within a range of 6 to 7 [μmol/cm$^3$].

5. The metal halide lamp according to claim 1, characterized in that said discharge tube contains thulium iodide ($TmI_3$), thallium iodide (TlI), sodium iodide (NaI), calcium iodide ($CaI_2$) and cerium iodide ($CeI_3$) as said metal halides.

6. The metal halide lamp according to claim 5, characterized in that said cerium iodide ($CeI_3$) has a molar ratio [%] ranging of from 4 to 5%.

7. The metal halide lamp according to claim 2, characterized in that a bulb wall loading defined by a value obtained when said lamp rated power P [W] is divided by a whole inner surface area S [cm$^2$] falls within a range of 15 to 25 [W/cm$^2$].

8. The metal halide lamp according to claim 2, characterized in that a mercury concentration in said discharge tube falls within a range of 43 to 48 [μmol/cm$^3$] and that a metal halide concentration d(MX) in said discharge tube falls within a range of 6 to 7 [μmol/cm$^3$].

9. The metal halide lamp according to claim 3, characterized in that a mercury concentration in said discharge tube falls within a range of 43 to 48 [μmol/$cm^3$] and that a metal halide concentration d(MX) in said discharge tube falls within a range of 6 to 7 [μmol/$cm^3$].

10. The metal halide lamp according to claim 2, characterized in that said discharge tube contains thulium iodide ($TmI_2$), thallium iodide (TlI), sodium iodide (NaI), calcium iodide ($CaI_2$) and cerium iodide ($CeI_2$) as said metal halides.

11. The metal halide lamp according to claim 3, characterized in that said discharge tube contains thulium iodide ($TmI_3$), thallium iodide (TlI), sodium iodide (NaI), calcium iodide ($CaI_2$) and cerium iodide ($CeI_3$) as said metal halides.

12. The metal halide lamp according to claim 4, characterized in that said discharge tube contains thulium iodide ($TmI_3$), thallium iodide (TlI), sodium iodide (NaI), calcium iodide ($CaI_2$) and cerium iodide ($CeI_3$) as said metal halides.

* * * * *

UNITED STATES PATENT AND TRADEMARK OFFICE

CERTIFICATE OF CORRECTION

PATENT NO. : 8,653,731 B2
APPLICATION NO. : 13/788086
DATED : February 18, 2014
INVENTOR(S) : Yasuhisa Matsumoto It is certified that error appears in the above-identified patent and that said Letters Patent is hereby corrected as shown below:

In the Claims
Claim 10, Col. 11, Line 6, "($TmI_2$)" should read -- ($TmI_3$) --.
Claim 10, Col. 11, Line 7, "($CeI_2$)" should read -- ($CeI_3$) --.

Signed and Sealed this
First Day of March, 2016

Michelle K. Lee

Michelle K. Lee
*Director of the United States Patent and Trademark Office*